United States Patent [19]

Maunz et al.

[11] Patent Number: 4,761,986

[45] Date of Patent: Aug. 9, 1988

[54] ARRANGEMENT FOR TRANSPORTING WORKPIECES IN MULTI-STAGE DEFORMATION PRESSES

[75] Inventors: Hermann Maunz, Goeppingen-Holzheim; Oskar Rahn, Goeppinen-Faurndau; Wilfried Voss, Eislingen, all of Fed. Rep. of Germany

[73] Assignee: L. Schuler GmbH, Goeppingen, Fed. Rep. of Germany

[21] Appl. No.: 47,145

[22] Filed: May 8, 1987

[30] Foreign Application Priority Data

May 10, 1986 [DE] Fed. Rep. of Germany ..... 3615812

[51] Int. Cl.[4] ..... B21J 13/08

[52] U.S. Cl. ..... 72/405; 72/422; 414/753; 294/116

[58] Field of Search ..... 72/405, 422; 294/116, 294/88; 414/753, 750; 279/38–40, 107

[56] References Cited

U.S. PATENT DOCUMENTS

| | | | |
|---|---|---|---|
| 2,822,094 | 2/1958 | Greer | 294/116 |
| 3,630,391 | 12/1971 | Wilson | 72/405 |
| 3,994,403 | 11/1976 | Steinhauser . | |
| 4,589,817 | 5/1986 | Adinolfi et al. | 294/116 |

FOREIGN PATENT DOCUMENTS

| | | | |
|---|---|---|---|
| 1174023 | 7/1964 | Fed. Rep. of Germany | 294/116 |
| 1802629 | 6/1969 | Fed. Rep. of Germany . | |
| 2434540 | 9/1983 | Fed. Rep. of Germany . | |
| 1239640 | 7/1971 | United Kingdom . | |
| 1350043 | 4/1974 | United Kingdom . | |
| 663577 | 5/1979 | U.S.S.R. | 294/88 |

*Primary Examiner*—Daniel C. Crane

*Attorney, Agent, or Firm*—Barnes & Thornburg

[57] ABSTRACT

An arrangement for the transport of workpieces in a multi-stage deformation press in which the workpieces are to be seized by gripping tongs and are to be transferred in the deformation stages. The gripping tong consists essentially of a base body which is displaced in the direction of a deflection movement by way of a coupling rod. The base body carries a pivot support in which the gripping arms are rotatably supported in pivot joints. The areas of the gripping arms remote from the workpiece are pivotally connected at the base body by way of a coupling member. Within the area of the pivotal connection, the gripping arms carry rollers which are placed from the outside against curved regions of a cam plate by way of a compression spring between the base body and the pivot support. One cam region is on the shape of a circular arc about the pivot bearing so that a larger closing and opening movement is imposed on the gripping arms.

12 Claims, 3 Drawing Sheets

ARRANGEMENT FOR TRANSPORTING WORKPIECES IN MULTI-STAGE DEFORMATION PRESSES

BACKGROUND OF THE INVENTION

The presen invention relates to an arrangement for transporting workpieces in a multi-stage deformation press, including a number of gripping tongs, each consisting of two non-crossing gripping arms which are mutually pivotally supported in a pivot joint and which carry out a transfer or translatory movement extending perpendicularly to the working direction of the work tools by means of a gripper support plate, whereby the gripping arms are pivotally connected with drive transmitting elements in pivot places remote from the workpiece holding areas and are positively guided by at least partially curved cam regions, whereby a deflection movement extending transversely to the translatory movement and to the working direction of the work tools is imposed on each gripping tong by a drive during the transfer or translatory movement, on which is superimposed an opening and closing movement.

During the translation or transfer of the workpieces in deformation presses serving for the solid deformation, gripping tongs are provided which, in addition to the translatory movement, in which workpieces are removed from an input station and are transferred to deformation stations, additionally carry out a deflection movement away from the work tools and toward the same. An opening-closing movement for the release of the workpieces, respectively, for seizing the same, is superimposed on this deflection movement.

An arrangement of the aforementioned type is disclosed in the DE-PS No. 24 34 548 and corresponding U.S. Pat. No. 3,994,403 in which the pivot points of the gripping arms are combined in a common joint. However, the joint is not frame-guided. The pivot points for the drive which are remote from the holding area for the workpiece, are positively guided on at least partially curved tracks. The overall construction is very massive and therefore does not permit any rapid transfer or translatory movements. Furthermore, the workpieces are somewhat pulled or torn along during the transfer to the work tool and during the removal from the work tool, and as a result thereof the workpieces might cant or edge.

SUMMARY OF THE INVENTION

In contrast thereto, it is the object of the present invention to provide an operationally reliable handling of the workpieces. In particular, a longer movement phase of the holding areas at the gripping arms toward the workpiece, respectively, toward the gripping area at the workpiece and away from the same is to be achieved.

The underlying problems are solved according to the present invention in that each gripping arm is pivotally connected in the pivot place at a base body by way of a coupling member and the base body is operatively connected by way of a coupling rod with the drive for a movement of the gripping tongs in the direction of the deflection movement, in that the gripping arms are rotatably supported on a pivot support in pivot joints, in that the pivot support is supported in the base body displaceable in the direction of the deflection movement, in that a spring seeking to hold the pivot support in the direction of the deflection movement toward a workpiece is installed between a collar at the pivot support and an abutment surface at the base body, and in that within the area of the pivot place a roller is attached at each gripping arm which is placed against a curved sheet metal cam plate at the gripper support plate which is movable together with the gripping tongs in the direction of the translatory movement, whereby the curved cam area at the cam plate is formed in such a manner that the roller, after rolling over a start-up area, is moved approximately on a circular arc about the pivot joint at the pivot support and the movement of the roller along this curved area leads to the standstill of the pivot support.

It is thereby of advantage that the roller is movable on the curved parts of the cam plate by the interposition of coupling members between the region at the gripping arm remote from the workpiece holding means whereas the spring connected between the pivot support of the gripping arms and the base body brings about the abutment of the roller at the cam plate. The guidance of the pivot support under prestress in the base body and the abutment of the rollers at the cam plates lead to a safe and reliable handling of the workpieces to be transported. Of further advantage is the soft stepless transition of the roller movement along the cam plate up to the transition into the circular-arc shaped cam area which leads to a soft braking and to the standstill of the pivot support. The proportion of the movement phase of the opening and closing movement increases owing to the mutually spaced suspension of the gripping arms at the pivot support and the workpiece holding means of both gripping arms are thus reliably guided toward the workpiece and away from the same. The gripping arms are adapted to be finely adjusted for their abutment at the workpieces by means of eccentric bearing supports.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figures 1, 2, 3:
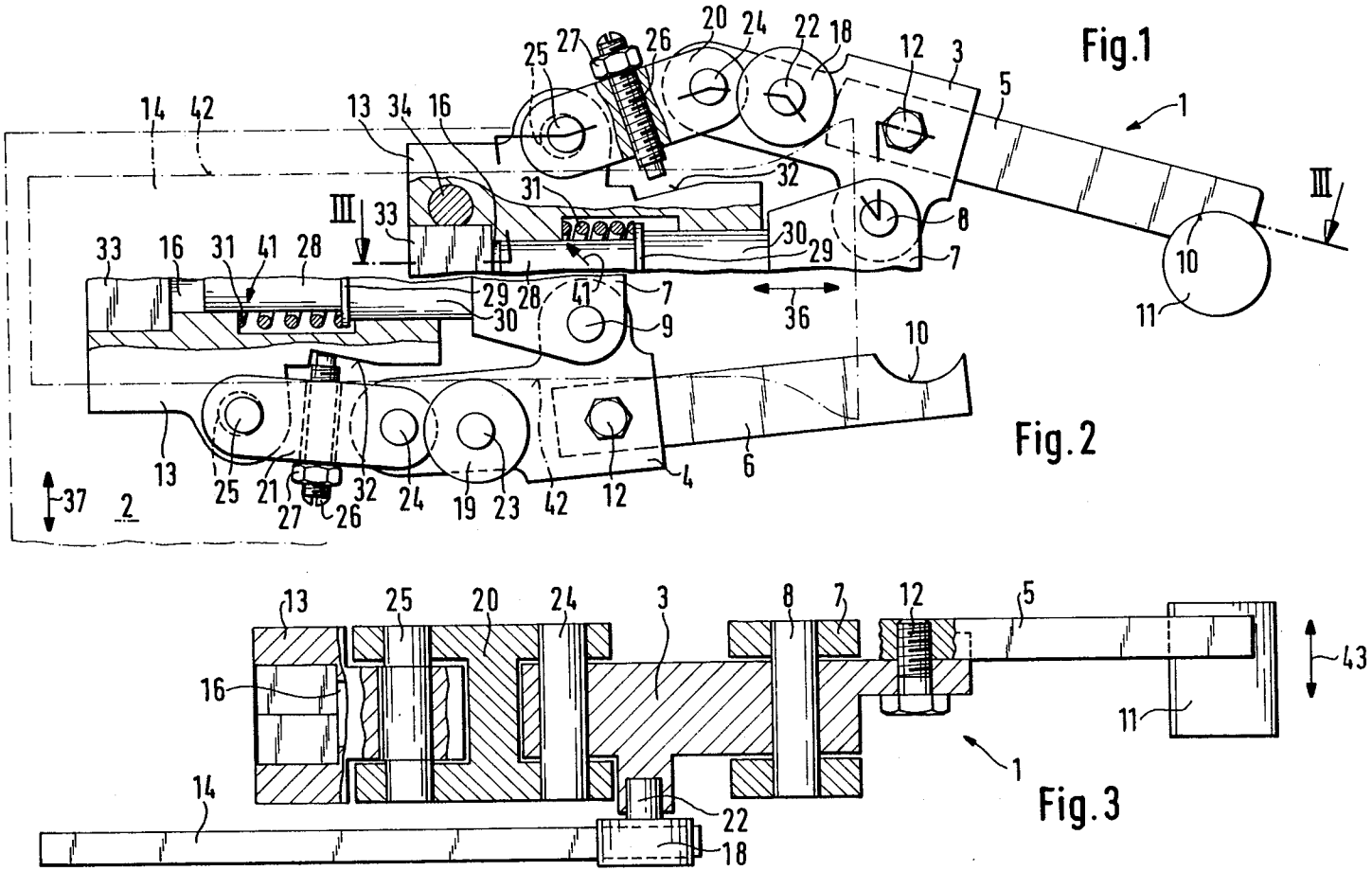
FIG. 1 is a plan view on one-half of a gripping tong in accordance with the present invention in the position seizing a workpiece.
FIG. 2 is a plan view on the second half of the gripping tong in accordance with the present invention in a position retracted from a workpiece.
FIG. 3 is a cross-sectional view through the bearing places of the gripping tong taken along line III—III of FIG. 1.

Referring now to the drawing wherein like reference numerals are used throughout the various views to designate like parts, and more particularly to FIGS. 1 and 2, the gripping support plate 2 indicated in these figures in dash and dotted lines, is displaceable by a drive (not shown) by a distance in the direction of the double-arrow 37 indicating the translatory movement of workpieces 11 in the deformation stages, which corresponds to the spacing of the deformation stages. The gripping support plate 2 carries a number of gripping tongs generally designated by reference numeral 1 which are arranged at the distance of the deformation stages, and of which one gripping tong 1 is illustrated. The gripping tong 1 is adapted to be reciprocatingly displaced on the gripping support plate 2 perpendicularly to the translatory movement 37 toward a workpiece 11 and away from the same in the direction of the double-arrow 36, for example, in guide means. A curved cam member 14, for example, a curved sheet-metal plate, is fastened at the gripping support plate 2 whose cam portions will be explained more fully hereinafter by reason of the special effects on the movements (coupling curve) of the gripping tongs 1. The cam member 14, shown in dash and dotted lines in FIGS. 1 and 2, is located above the gripping tongs 1 and is illustrated as adjoining part in dash and dotted lines in order not to cover off the details of the gripping tong 1 disposed therebelow. A base body 13 of the gripping tong 1 is provided within a central area with rectangular inner surfaces 33 for the fastening at a correspondingly shaped pin (not shown) which is arranged at the gripping support plate 2. A clamping screw 34 arrests the fastening position of the base body 13 at the gripping support plate 2. Furthermore, the central area of the base body 13 is provided with a longitudinal bore 16 having different diameters for receiving pins 28 and 30 of a pivot support 7. The pivot support 7 is displaceably supported in the longitudinal bore 16 of the base body 13 in the direction 36 toward the workpiece 11 and away from the same by means of the pins 28 and 30. The adjusting movement of the base body 13 and therewith that of the gripping tong 1 is effected by a coupling rod 35 illustrated in FIGS. 4 and 5 which is acted upon, for example, by a cam follower placed against a control cam. The control cam and cam follower are not shown in the drawing as they are of any known construction. A compression spring is inserted under prestress between a collar 29 at the pivot support 7 and an abutment surface 41 in the base body 13. Pivot joints 8 and 9 for a respective gripping arm are machined into the pivot support 7. The gripping arms consist essentially of a gripping arm holder 3 and 4 and of a tong-portion 5 and 6. The tong-portions 5 and 6 are fixed at the respective gripping arm holder 3 and 4 by threaded means 12. The tong portions 5 and 6 include each a workpiece holding means 10. In the area of each gripping arm 3, 5, respectively, 4, 6, remote from the workpiece holding means 10, pivot places 24 are provided in which one respective coupling member 20, 21 per gripping arm 3, 5, respectively, 4, 6 is pivotally supported. The opposite side of each coupling member 20, 21 is pivotally supported at the base body 13, whereby the bearing place is formed by an eccentric bolt 25. Each coupling member 20, 21 is adjustable by the eccentricity of its eccentric bolt 25 and is adapted to be fixed by arresting means in the undertaken adjusted position. Each coupling member 20, 21 carries in its center portion a threaded pin 26 which during the assembly of the gripping tongs 1 is adjusted against an abutment surface 32 on the base body 13 for the preadjustment of the gripping arms 3, 5, respectively, 4, 6. The preadjustment is to be secured by means of a counter nut 27. Within the area of the pivot place 24, a roller 18, 19 is rotatably supported on a pin 22, 23 at each gripping arm 3, 5, respectively, 4, 6, and more particularly, as can be seen from FIG. 3, at the height of the curved cam member 14. The adjustment of the rollers 18, 19 during the assembly by means of the threaded pins 26 takes place in such a manner that the rollers 18, 19 abut at the straight cam portion 42 of the cam plate 14 under the pressure of the compression spring 31. Corresponding to the position of the rollers 18, 19 at the cam plate 14, the gripping tong 1 is in FIG. 1 in a position holding a workpiece 11 or in FIG. 2 in an open position retracted from the workpiece 11.

FIG. 3 illustrates a cross section of the pivot places 8, 22, 24 and 25 of a gripping tong 1. The working direction of the work tools in the deformation stages is indicated by the double arrow 43.

Figure 4:
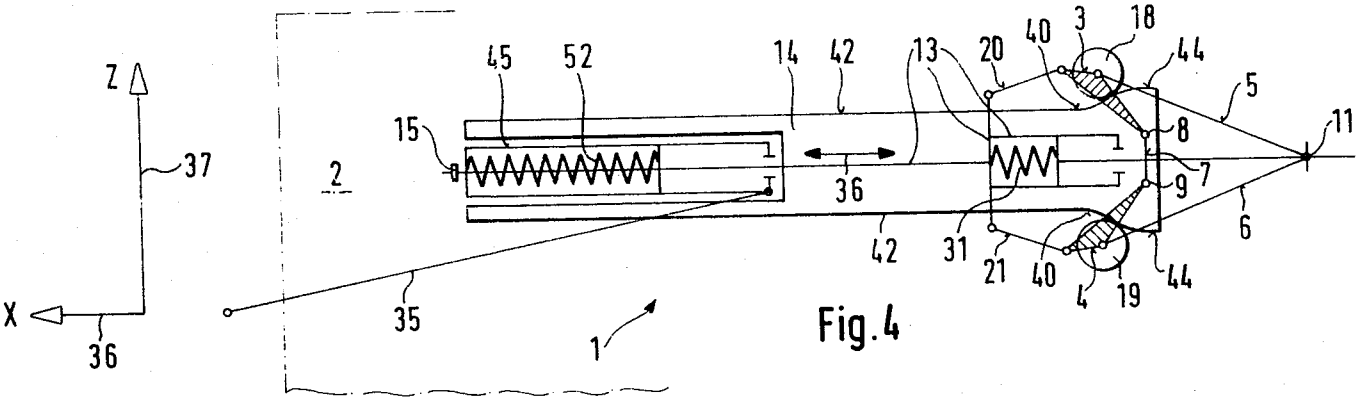
FIG. 4 is a schematic view of the operation of the gripping tongs in a position seizing a workpiece.
Figure 5:
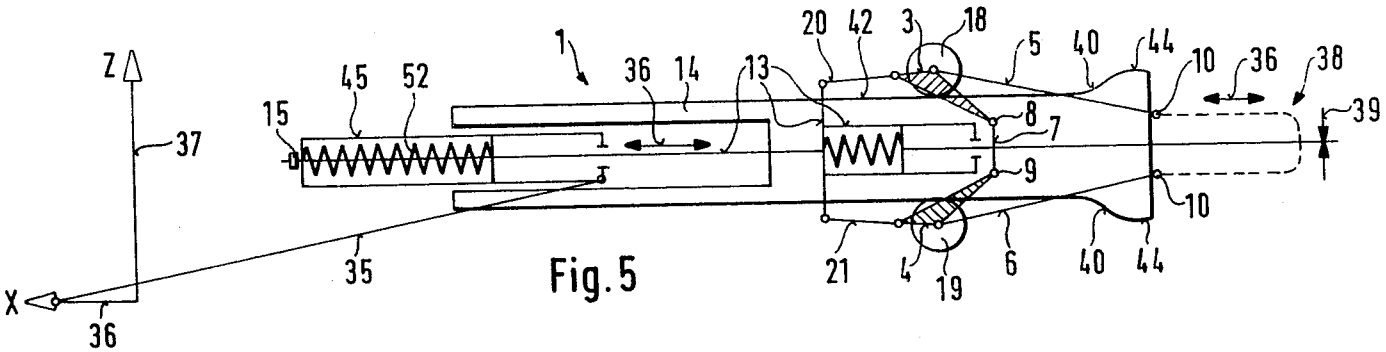
FIG. 5 is a schematic view, similar to FIG. 4, of the gripping tongs in a position retracted from a workpiece.

FIGS. 4 and 5 illustrate schematically the construction of a gripping tong 1 in the gripping position (FIG. 4) and in the open position (FIG. 5). The coupling rod 35 which is moved by the already mentioned cam drive, is connected, for example, by a spring housing part 45 and, for example, by a compression spring 52 to the base body 13 in order to displace the same on the gripping support plate 2 in the direction of the deflection movement 36. By the displacement of the base body 13 on the gripping support plate 2 in the direction 36 toward the workpiece 11, the rollers 18 and 19 are moved along the outer contour of the cam plate 14. After rolling over the straight cam portion 42, the rollers 18 and 19 are displaced by way of a start-up area 40 passing over into the circular-arc shaped area 44 and toward the outside in relation to the respective pivot joint 8, 9 of the gripping arm holder 3, respectively, 4. The start-up region 40 effects a soft braking movement of the gripping tongs 3, 5 and 4, 6 in the direction of the deflection movement 36 toward the workpiece 11 whereas the base body 13 is positively guided by the coupling rod 35. After rolling over the start-up region 40 and when reaching the cam region 44 of circular-arc shape, the pivot support 7 and therewith the gripping tong 1 comes to a standstill in the direction of the deflection movement 36 whereas the gripping tongs 3, 5 and 4, 6 carry out the closing movement 39, properly speaking, i.e., the gripping movement with a pivot movement about the pivot joints 8 and 9.

Figure 6:
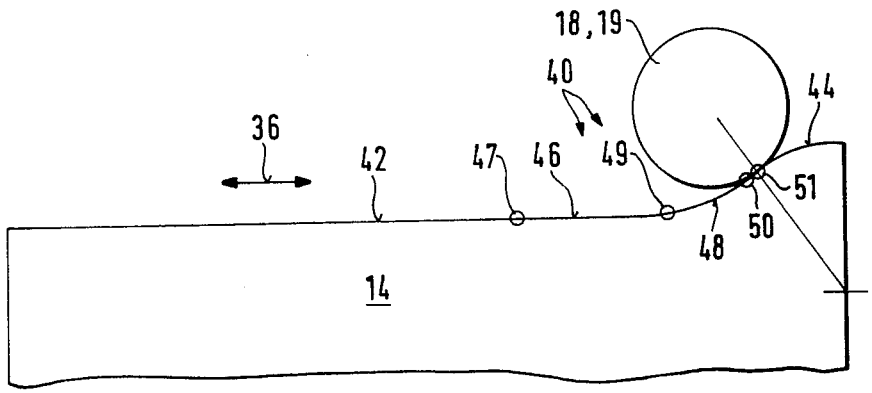
FIG. 6 is a partial view illustrating the shape of the curves at a curved cam plate.
Figure 7:
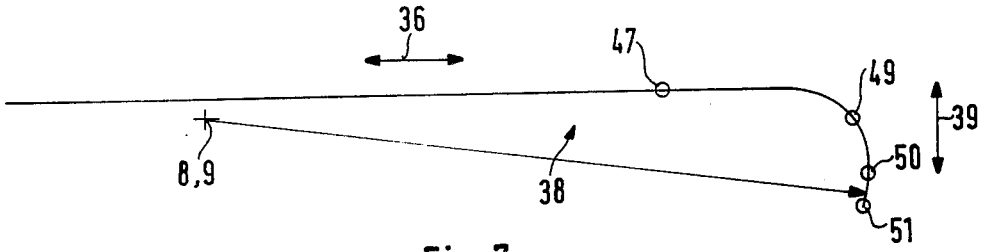
FIG. 7 is a diagrammatic view illustrating the movement (coupling curve) of the workpiece holding means at each gripping tong.

FIGS. 6 and 7 illustrate the dependency of the curve configuration at the cam plate 14 and the movement progress in the coupling curve 38 of the gripping arms 3, 5 and 4, 6. The cam plate 14 includes a start-up region 40 with a first region 46 rising relatively flat in relation to the movement directions 36 (deflection movement) between the cam points 47 and 49 and with a strongly rising region 48 between the cam points 49 and 50. The cam region 44 of circular-arc-shape begins with the point 50 of which for the clamping of the workpiece 11 in the illustrated embodiment, only the area up to the point 51 is utilized. The spacing of the points 50 and 51 from each other is dependent on the construction of the workpiece holding means 10 at the gripping arms 3, 5, respectively, 4, 6 and the size of the clamping area at the workpiece 11. The cam points 47, 49, 50 and 51 and the associated cam regions 46, 48, and 44 are transmitted onto the coupling curve 38 in FIG. 7 and characterize the movement progress of the gripping arms 3, 5 and 4, 6. The curve configuration illustrates a decrease of the movement of the gripping arms 3, 5 and 4, 6 toward the workpiece 11—in the direction of the double arrow 36—between the points 49 and 50 up to a movement which then also includes a slight return movement, with simultaneous increase of the movement of the gripping arms 3, 5 and 4, 6 in the upper workpiece holding area 10 toward the workpiece 11 between the points 50 and 51—in the direction of the double arrow 39. The opening movement as well as the movement of the gripping tong 1 guided away from the workpiece 11 takes place correspondingly in reverse sequence.

An abutment 15 is indicated in FIGS. 4 and 5 which is secured on the base body 13. Initially, the spring housing 45 is supported at the abutment 15 up to the instant in which the rollers 18 and 19 are displaced outwardly during the movement of the gripping tong 1—in the direction of the deflection movement 36—toward the workpiece 11 up to reaching the first flat area 46 of the cam member 14. As a result of the relative movement between the coupling rod 35 and the base body 13, which is spring-supported by the compression spring 52, the requisite gripping prestress is being built up with the movement of the gripping tong 1 toward the workpiece 11.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. An arrangement for transporting workpieces in a multi-stage deformation press having a support plate and work tools, comprising a number of gripping tong means including non-crossing gripping arm means pivotally supported with respect to one another in a pivot joint means and operable to carry out a translatory movement extending substantially perpendicularly to the working direction of a work tool by a gripping support plate means, the gripping arm means including workpiece holding means, drive transmission elements pivotally connected with the gripping arm means in pivot places remote from the workpiece holding means, at least partially curved cam means on said support plate for positively guiding the gripping arm means, means for imposing on each gripping tong means during the translatory movement of said gripping tong means a deflection movement extending substantially transversely to the translatory movement and to the working direction of the work tools, and means for superimposing on said deflection movement, an opening and closing movement, a base body means, including a coupling member pivotally connecting each gripping arm means in its pivot place at the base body means, said base body means being operatively connected by way of a coupling rod with its drive for a movement of the gripping tong means in the direction of the deflection movement, the gripping arm means being rotatably supported in said pivot joint means on a pivot support means, the pivot support means being displaceably supported in the base body means in the direction of the deflection movement, said pivot support means including a collar, and said base body means including an abutement surface, a spring between said collar and said abutement surface seeking to hold the pivot support means in the direction of the deflection movement toward a workpiece, and roller means provided at each gripping arm means within the area of its pivot place, said roller means being placed against the cam means, which is movable along with the gripping tong means in the direction of the translatory movement, and the curved region at the cam means being formed in such a manner that a respective roller means after rolling over a starting region, is displaced about an approximately circular arc whose radial center point is its pivot joint means and the movement of the roller means on said curved region stops the deflection movement of the pivot support means and superimposes said opening and closing movement on said deflection movement.

2. An arrangement according to claiam 1, wherein one gripping arm means is supported at the pivot support means in a first pivot joint and the other gripping arm means is supported at the pivot support means in a second pivot joint and the first and second pivot joints are spaced from one another.

3. An arrangement according to claim 1, wherein each coupling member is supported at the base body means by way of an eccentric bolt.

4. An arrangement according to claim 1, wherein the base body means is provided with an internal rectangular aperture, and a clamping bolt at the base body means for fixing the base body means at the support plate.

5. An arrangement according to claim 1, wherein said curved cam means whose abutment regions for the roller means extend essentially in the direction of the deflection movement, include a substantially straight cam portion, a start-up cam portion adjoining the straight cam portion in the direction toward the workpiece holding means of a respective gripping arm means and a cam portion of circular-arc shape adjoining the start-up portion which is formed by a radius whose radial dimension results from the distance of the circular arc-shaped cam portion to the pivot joint means of the respectively associated gripping arm means.

6. An arrangement according to claim 5, wherein the cam portions are outer contours of the cam means.

7. An arrangement according to claim 1, wherein each roller means is supported on a pin within the area near the respective pivot place and between the pivot place and the workpiece holding means.

8. An arrangement according to claim 5, wherein one gripping arm means is supported at the pivot support means in a first pivot joint and the other gripping arm means is supported at the pivot support means in a second pivot joint and the first and second pivot joints are spaced from one another.

9. An arrangement according to claim 5, wherein each coupling member is supported at the base body means by way of an eccentric bolt.

10. An arrangement according to claim 5, wherein the base body means is provided with an internal rectangular aperture, and a clamping bolt at the base body means for fixing the base body means at the support plate.

11. An arrangement according to claim 5, wherein each roller means is supported on a pin within the area near the respective pivot place and between the pivot place and the workpiece holding means.

12. An arrangement for transporting workpieces in a multi-stage deformation press, comprising gripping tong means for seizing the workpieces and transferring the same into the deformation stages, the gripping tong means including a base body means operable to be displaced by way of a coupling rod in the direction of a deflection movement, the base body means carrying a pivot support means, the gripping tong means inclcuding gripping arms pivotally supported in pivot joints on said pivot support means, the areas of the gripping arms remote from the workpiece being pivotally connected by a coupling member to the base body means, roller means on the gripping arms within the area of the pivotal connection thereof, said roller means ride along curved regions of a cama means, a spring means between the base body means and the pivot support means, and a first curved region of the cam means being constructed in the shape of a circular arc whose radial center point is the pivot joints as a result of which said pivot support means will stop its deflection movement before said base body means stops its deflection movement and while said gripping arms pivot.

* * * * *